US005347977A

United States Patent [19]

Lehikoinen et al.

[11] Patent Number: 5,347,977

[45] Date of Patent: Sep. 20, 1994

[54] COMBINATION OF A BAKING OVEN AND A STOVE

[75] Inventors: Antti Lehikoinen, Juuka; Kyösti Nuutinen, Nunnanlahti, both of Finland

[73] Assignee: Suomen Voulukivi OY, Nunnanlahti, Finland

[21] Appl. No.: 39,071

[22] Filed: Apr. 8, 1993

[30] Foreign Application Priority Data

Oct. 26, 1990 [FI] Finland ..... 905306

[51] Int. Cl.[5] ..... A21B 1/00

[52] U.S. Cl. ..... 126/19 R; 126/1 D; 126/4

[58] Field of Search ..... 126/4, 8, 3, 1 D, 19 R, 126/273 R

[56] References Cited

U.S. PATENT DOCUMENTS 4,095,586 6/1978 Selva .
4,850,332 7/1989 Sivonen .

FOREIGN PATENT DOCUMENTS 25423 11/1951 Finland .

*Primary Examiner*—Carroll B. Dority
*Attorney, Agent, or Firm*—Watson, Cole, Grindle & Watson

[57] ABSTRACT

A combination of a baking oven and a stove includes a stove (1) for burning wood, an ash chest (3) under the stove, and a baking oven (2) above the stove. A conduit (8) extends from a furnace (7) of the stove into a secondary combustion chamber (9) above the baking oven and below a fire cover (13), and cheek conduits are provided. The conduits (8 and 11) of the baking oven (2) and the stove (1) for conveying combustion and flue gases are substantially separate from each other below the secondary combustion chamber (9) in such a way that the conduit (11) extending from the furnace (10) of the baking oven for passing the combustion and flue gases formed in the baking oven into the secondary combustion chamber is separate from the conduit (8) extending from the stove for passing the combustion and flue gases formed in the stove into the secondary combustion chamber.

7 Claims, 2 Drawing Sheets

COMBINATION OF A BAKING OVEN AND A STOVE

BACKGROUND OF THE INVENTION

1. Field of the Invention

The invention relates to a combination of a baking oven and a stove, comprising a stove for burning wood, an ash chest under the stove, and a baking oven above the stove, whereby a conduit extends from a furnace of the stove into a secondary combustion chamber positioned above the baking oven and below a fire cover, cheek conduits being arranged to extend downwards from the secondary combustion chamber on both sides of the combination into a flue of the combination.

2. The Prior Art

Combinations of a baking oven and a wood burning stove are known from the prior art. The baking oven may therein be provided with smoke openings. In this kind of arrangement the baking oven is not very well suited for burning wood, since the supply of air into the baking oven is difficult to arrange: the feed door of the baking oven has to be provided with air supply openings arranged to be closed tightly when the stove is used. Such a feed door is difficult to manufacture. In practice, the baking oven in this type of arrangement is heated by efficient heating of the stove. Plenty of wood thereby has to be burned in the stove to achieve a sufficient baking temperature, as the heating of the mass of the stove requires plenty of heat energy. Another problem is that the back portion of the baking oven does not warm up properly, and the glass of the furnace and the feed door becomes sooty.

An arrangement is also known in which the baking oven is not provided with smoke openings but combustion and flue gases are passed through the back portion into a secondary combustion chamber positioned above the baking oven. This structure operates in a desired manner when the stove and the baking oven are heated at different times. However, when the baking oven is to be used separately, a damper has to be provided between the baking oven and the stove. The damper complicates the construction and its use is always more or less inconvenient.

Further, combinations of a baking oven and a wood burning stove are known in which the stove and the baking oven have their own conduits for combustion and flue gases, which conduits lead into two separate flues. A problem with this kind of combination is that it is complicated as such, and warms up unevenly, which results in that the construction tends to "live". Furthermore, the dropping of coal is difficult.

SUMMARY OF THE INVENTION

The object of the present invention is to eliminate the above-mentioned problems associated with the prior art oven-stove combinations. To achieve this, the combination of a baking oven and a stove according to the invention is characterized in that the conduits of the baking oven and the stove for conveying combustion and flue gases are substantially separate from each other below the secondary combustion chamber in such a way that the conduit extending from the furnace of the baking oven for passing the combustion and flue gases formed in the baking oven into the secondary combustion chamber is separate from the conduit extending from the stove for passing the combustion and flue gases formed in the stove into the secondary combustion chamber. Preferably, the conduit of the baking oven is positioned at the back of the baking oven while the conduit of the stove is positioned behind the conduit of the baking oven. As a result, the oven-stove combination is simple, its width is small, and heat is able to transfer from one conduit to the other for preheating the conduits. When the width of the conduit of the furnace of the stove corresponds substantially to the width of the furnace of the baking oven, transfer of heat from the baking oven to the conduit of the stove, and vice versa, is made efficient and even. Preferably, the conduits of the stove and the baking oven are separated from each other by means of a substantially vertical fire-resistant wall, which forms the back wall of the baking oven.

The present invention is based on the idea that combustion and flue gases from the baking oven and the stove are passed into the secondary combustion chamber along separate conduits so that the gases are not mixed until they reach the secondary combustion chamber, and so the baking oven and the stove can be used independently of each other: the baking oven can be used independently of the stove for baking and/or heating, and the stove can be used independently of the baking oven for heating and/or for burning wood for pleasure, whereby the use of the oven and the stove does not require the provision of a damper between them. The omission of the damper also simplifies the structure of the oven-stove combination. A further advantage of the present combination is that the baking oven warms up evenly without the buildup of soot.

BRIEF DESCRIPTION OF THE DRAWINGS

In the following the invention will be described in greater detail with reference to the attached drawing, in which.

DETAILED DESCRIPTION OF THE PREFERRED EMBODIMENT

Figure 1:
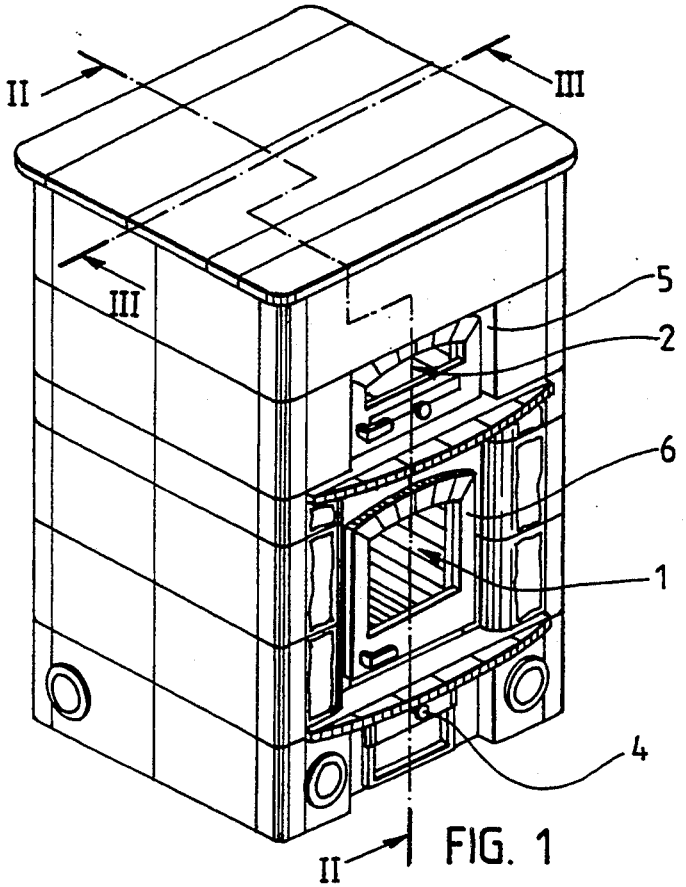
FIG. 1 is a perspective view of a combination of a baking oven and a stove according to the invention.
Figure 2:
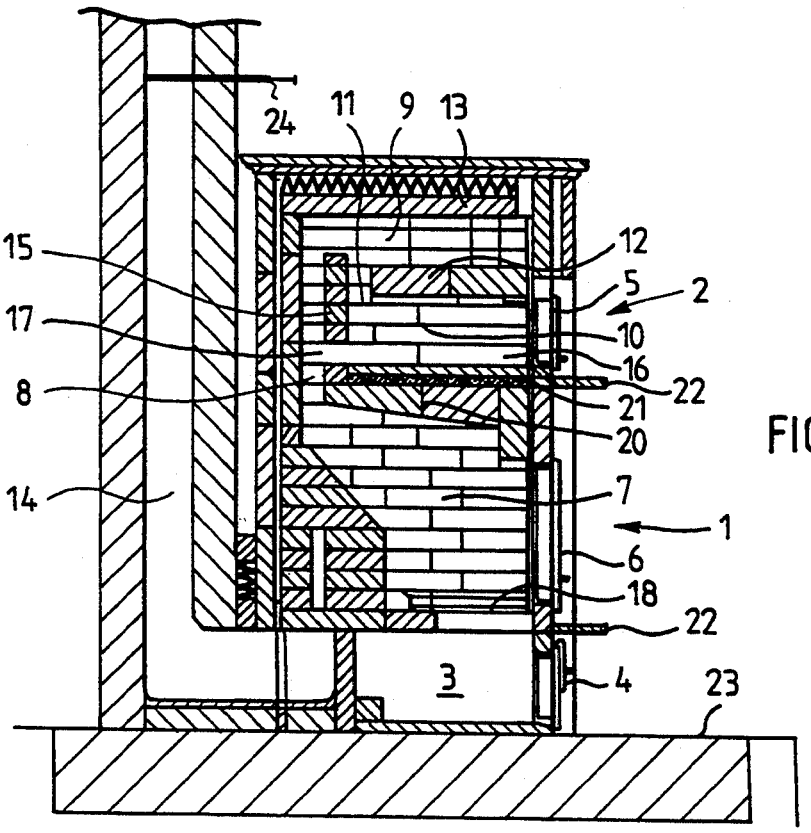
FIG. 2 is a cross-sectional view of the combination of FIG. 1, as seen along line II—II.
Figure 3:
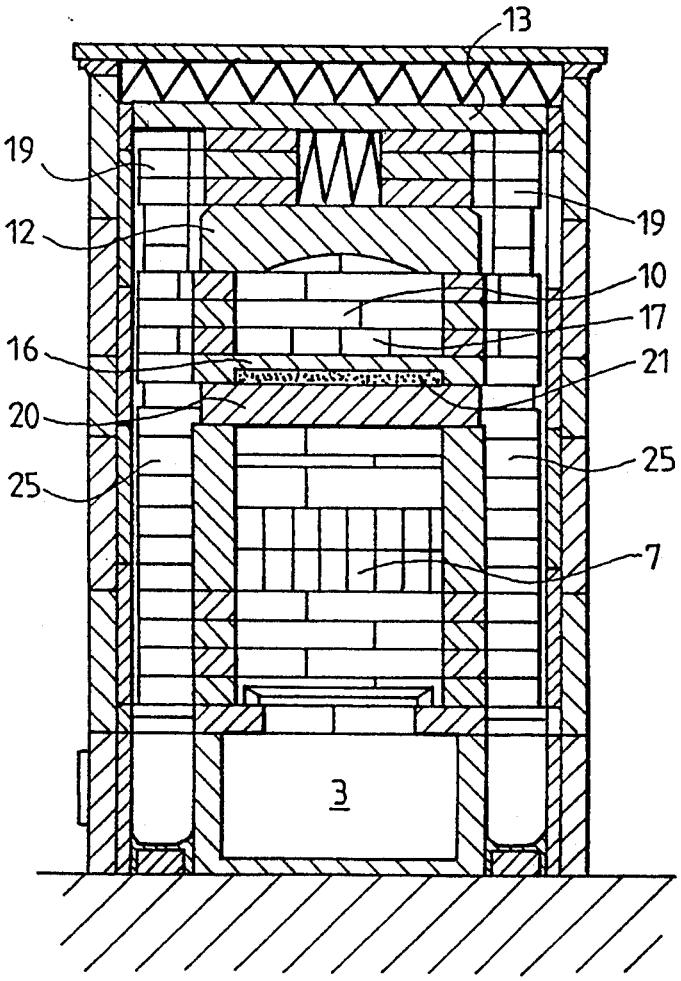
FIG. 3 is a cross-sectional view of the combination of FIG. 1 as seen along line III—III.
Figure 4:
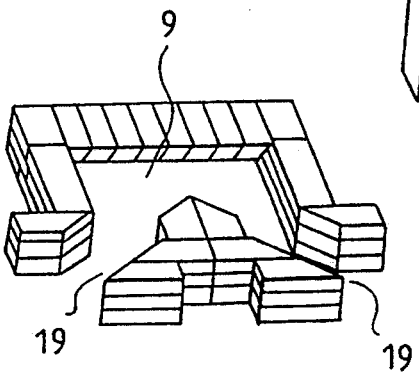
FIG. 4 is a perspective view of a detail of the combination of FIG. 1.
Figure 5:
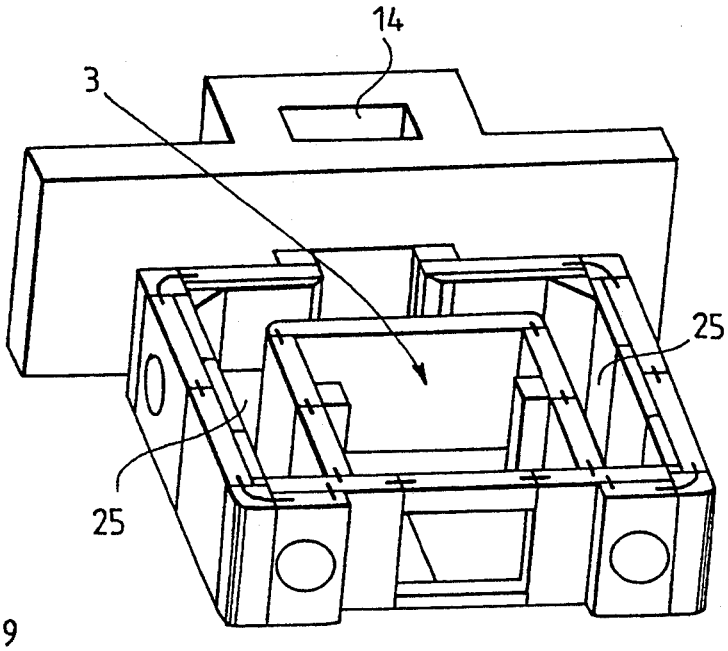
FIG. 5 is a perspective view of another detail of the combination of FIG. 1.

The combination of a baking oven and a stove shown in FIGS. 1–5 comprises a stove 1 for burning wood and above it a baking oven 2. Under the stove 1 there is provided an ash chest 3 with a door 4. The feed door of the baking oven 2 is indicated with the reference numeral 5 and the door of the stove 1 is indicated with the reference numeral 6. A conduit 8 extends from the furnace 7 of the stove 1 for passing combustion and flue gases formed in the stove into a secondary combustion chamber 9 positioned at the top. Similarly, a conduit 11 extends from the furnace 10 of the baking oven 2 for passing combustion and flue gases formed in the baking oven into the secondary combustion chamber 9, which is positioned above a vault 12 of the baking oven and below a fire cover 13. As shown in FIGS. 3 and 5, cheek conduits extend downwards from the secondary combustion chamber 9 on both sides of the feed door 5 and end up in a flue 14 of the combination for removing combustion gases from the secondary combustion chamber. It appears from FIG. 2 that the conduit 8 of the stove 1 is positioned behind the conduit 11 of the baking oven 2, whereby the conduits are separated by the back wall 15 of the baking oven. The back wall 15 of the baking oven 2 is substantially vertical and extends up to the secondary combustion chamber 9 above the lower surface of the vault 12. The width of the conduit 8 corresponds substantially to the width of the furnace 10 of the baking oven 2. The back wall 15, made of a fire-resistant material, is provided at its bottom edge with a low coal dropping opening 17 in level with or immediately above grate stones 16. The coal dropping opening 17 leads into the conduit 8 of the stove 1, and so the coal is dropped onto a coal burning grate 18 of the stove 1 above the ash chest 3. The coal dropping opening 17 is so small in size and is positioned so low in the baking oven 2 that no combustion and flue gases from the baking oven escape through it into the conduit 8. In practice, this arrangement keeps the combustion and flue gases of the baking oven 2 and the stove 1 fully apart from each other.

It further appears from FIG. 2 that the vault 12 of the baking oven 2 extends from the front portion of the baking oven substantially to its back wall 15, and it is seen in FIG. 4 that openings 19 leading from the secondary combustion chamber 9 into the cheek conduits 25 are positioned close to the front wall of the combination. The reference numeral 20 indicates the vault of the stove 1, the reference numeral 21 indicates grate powder, the reference numeral 22 indicates the planes of the baking oven and the stove, the reference numeral 23 indicates the bottom of the oven-stove combination and the reference numeral 24 indicates a damper in the flue 14.

The most advantageous material for the manufacture of the oven-stove combination according to the invention is soapstone, the thermal capacity of which per volume unit is considerably greater than that of other stone materials. The combination is also easy to assemble when using accurately dimensioned, numbered soapstone elements, which in itself are easy to produce.

The invention has been described above only by means of one preferred embodiment, and it is to be understood that the details of the oven-stove combination according to the invention can be realized in many ways within the scope of the accompanying claims. Accordingly, the conduit of the stove need not necessarily extend behind the conduit of the baking oven, but it is also possible that one or more conduits are positioned at the sides of the combination. For the reasons set forth above, it is, however, advisable to position the conduit(s) of the stove behind the conduit of the baking oven. The coal dropping opening need not necessarily be positioned in the vertical back wall of the baking oven 2, but it could be positioned close to the feed door of the baking oven. In such a case, however, the coal dropping opening is less safe, as the coal may fall out of the feed door. The shape of the furnaces of the stove and the baking oven may, of course, deviate from those shown in the figures.

We claim:

1. Combination of a baking oven and a stove, comprising means forming a stove for burning wood, means forming an ash chest under the stove, means forming a baking oven above the stove, means forming a secondary combustion chamber above the baking oven, means forming a fire cover above the secondary combustion chamber, and means forming a flue, wherein a first conduit for combustion and flue gases extends from the stove into said secondary combustion chamber, wherein a second conduit for combustion and flue gases extends from said baking oven to said secondary combustion chamber, wherein cheek conduits extend downwardly from the secondary combustion chamber on both sides of the combination into said flue, and wherein the first and second conduits are substantially separate from each other.

2. Combustion according to claim 1, wherein the second conduit is at a back of the baking oven and the first conduit is positioned behind the second conduit.

3. Combination according to claim 2, wherein a width of the first conduit corresponds substantially to a width of the baking oven.

4. Combination according to claim 3, wherein the first and second conduits are separated from each other by means of a substantially vertical fire-resistant wall which forms the back wall of the baking oven.

5. Combination according to claim 4, wherein the fire-resistant wall defines a coal dropping opening level with grate stones of the baking oven, which coal dropping opening communicates with the first conduit.

6. Combination according to claim 4, including a vault common with the baking oven and the secondary combustion chamber, which vault extends from a front portion of the baking oven substantially to the back wall of the baking oven, whereby the second conduit is defined by the vault and the back wall of the baking oven.

7. Combination according to claim 6, including means forming openings above said vault which communicate said secondary combustion chamber with said cheek conduits for removing flue gases from the secondary combustion chamber.

* * * * *

UNITED STATES PATENT AND TRADEMARK OFFICE

CERTIFICATE OF CORRECTION

PATENT NO. : 5,347,977

DATED : September 20, 1994

INVENTOR(S) : Antti LEHIKOINEN

It is certified that error appears in the above-identified patent and that said Letters Patent is hereby corrected as shown below:

On the title page, item:

[73] Assignee: Suomen Vuolukivi Oy, Nunnanlahti, Finland

Signed and Sealed this

Twenty-fourth Day of January, 1995

*Attest:*

*Attesting Officer*

BRUCE LEHMAN

*Commissioner of Patents and Trademarks*